US005987374A

United States Patent [19]

Akutsu et al.

[11] Patent Number: 5,987,374

[45] Date of Patent: Nov. 16, 1999

[54] VEHICLE TRAVELING GUIDANCE SYSTEM

[75] Inventors: Eisaku Akutsu; Keiji Aoki, both of Susono, Japan

[73] Assignee: Toyota Jidosha Kabushiki Kaisha, Toyota, Japan

[21] Appl. No.: 08/884,478

[22] Filed: Jun. 27, 1997

[30] Foreign Application Priority Data

Jul. 8, 1996 [JP] Japan ..... 8-177641

[51] Int. Cl.[6] ..... G08G 1/01

[52] U.S. Cl. ..... 701/117; 701/119

[58] Field of Search ..... 701/117, 118, 701/119, 23; 340/992, 993; 180/169; 342/51

[56] References Cited

U.S. PATENT DOCUMENTS

| | | | |
|---|---|---|---|
| 4,215,759 | 8/1980 | Diaz | 180/168 |
| 4,361,202 | 11/1982 | Minovitch | 180/168 |
| 4,401,181 | 8/1983 | Schwarz | 180/168 |
| 4,656,463 | 4/1987 | Anders et al. | 340/572 |
| 4,780,817 | 10/1988 | Lofgren | 364/424.01 |
| 4,962,457 | 10/1990 | Chen et al. | 364/443 |
| 5,127,486 | 7/1992 | Yardley et al. | 180/168 |
| 5,189,612 | 2/1993 | Lemercier et al. | 364/424.02 |
| 5,196,846 | 3/1993 | Brockelsby et al. | 340/933 |
| 5,229,941 | 7/1993 | Hattori | 364/424.02 |
| 5,289,183 | 2/1994 | Hassett et al. | 340/905 |
| 5,331,561 | 7/1994 | Barrett et al. | 364/447 |
| 5,347,456 | 9/1994 | Zahng et al. | 364/424.02 |
| 5,357,432 | 10/1994 | Margolis et al. | 364/424.02 |
| 5,369,591 | 11/1994 | Broxmeyer | 364/461 |
| 5,381,095 | 1/1995 | Andrews | 324/326 |
| 5,387,916 | 2/1995 | Cohn | 342/44 |
| 5,420,794 | 5/1995 | James | 364/436 |
| 5,504,482 | 4/1996 | Schreder | 340/995 |

FOREIGN PATENT DOCUMENTS

| | | |
|---|---|---|
| 1-64236 | 4/1989 | Japan . |
| 1-253007 | 9/1989 | Japan . |
| 7-334789 | 12/1995 | Japan . |
| 8-314540 | 11/1996 | Japan . |

*Primary Examiner*—Michael J. Zanelli
*Attorney, Agent, or Firm*—Kenyon & Kenyon

[57] ABSTRACT

A traveling guidance system provides a traveling vehicle with various types of data indicating the flow of traffic to smooth travel. The speed and pass time data of the preceding vehicle is sent to an electronic wave tag laid on a road surface. The electronic wave tag then sends the data to the succeeding vehicle when it passes over the electronic wave tag. Furthermore, the received data is sent to a control center through communication equipment, which predicts the occurrence of traffic congestion based on the speed and pass time data of vehicles at each point and sends the prediction to electronic wave tags at points where the occurrence of traffic congestion is predicted. Traffic data from the control center is sent to passing vehicles through the electronic wave tag and each passing vehicle controls its travel based on the traffic data.

4 Claims, 5 Drawing Sheets

VEHICLE TRAVELING GUIDANCE SYSTEM

FIELD OF THE INVENTION

This invention relates to a vehicle traveling guidance system and, more particularly, to a guidance system including data providing sources laid on a road surface.

DESCRIPTION OF THE RELATED ART

Various guidance systems have been suggested in order to facilitate driving operation of a vehicle operator.

For example, traveling control methods and apparatus of an unmanned conveying vehicle described in Japanese Patent Laid-Open Publication No. Hei 1-253007, include allowing an unmanned conveying vehicle to travel along a road by laying magnetic markers at fixed points on a traveling track, detecting the magnetic field strength of these magnetic markers with a magnetic field detector, and controlling the vehicle so that a shift of the vehicle in relation to the road becomes smaller.

However, in order to accurately detect a shift of a vehicle in relation to a road, a large number of magnetic markers must be laid at short intervals. This causes the problems of extensive laying work and resulting high cost.

In a related application, Japanese Patent Application No. Hei 7-157878, the applicant of this application therefore taught suggested a configuration where magnetic generating means laid on a road surface provide a vehicle with data on the shape of the road surface. This configuration enables sure guidance of a vehicle without requiring the number of magnetic generating means laid at short intervals of the related art because a vehicle can recognize the shape of a road surface on which it is planning to travel in advance.

Even in this related art, however, the basic function of the magnetic generating means is limited to the provision of data on the shape of a road surface; it is difficult for the magnetic generating means to send a vehicle proper data for guidance according to traffic conditions changing every hour. Smoother guidance taking into consideration the flow of traffic was limited.

SUMMARY OF THE INVENTION

It is an object of the present invention to provide a system which enables proper guidance of a vehicle according to traffic conditions.

In order to achieve the above object, a vehicle traveling guidance system according to the present invention comprises a data providing device laid on a road and a vehicle, wherein a vehicle includes a data transmitter for sending a data providing device traveling data of the vehicle when the vehicle passes over the vicinity of the data providing device and a data receiver for receiving data sent from the data providing device. The data providing device includes a receiver for receiving the traveling data and a transmitter for sending other passing vehicles the traveling data. The data providing device not only sends data concerning the shape of the road, but also receives traveling data on a passing vehicle and sends this traveling data to other passing vehicles. Therefore, a vehicle operator can gain knowledge of the traveling state of a vehicle which has already passed over that point and adjust travel considering traffic flow.

In this case it is preferable that the data providing device should be an electronic wave tag laid on a road surface. Also, it is preferable that the traveling data should include vehicle pass time or vehicle pass time and speed. Furthermore, it is preferable that the number of data providing devices laid on a road should be greater than one and that there should be a control center for communicating through the data providing devices to a passing vehicle traffic data obtained from traveling data sent from each of the data providing devices. It is preferable that the control center should predict the occurrence of traffic congestion based on the pass time and speed of a vehicle included in the traveling data and communicate the occurrence of traffic congestion as the traffic data. It is assumed that at a certain point, vehicles were traveling smoothly at a certain time and the speed of each vehicle has decreased drastically at the next time. In this case it is expected that traffic congestion will occur in the vicinity of that point. Therefore, smooth travel can be achieved by, for example, communicating to each vehicle data etc. indicating bypasses in order not to worsen traffic congestion.

Furthermore, in order to achieve the above object, a vehicle traveling guidance system according to the present invention comprises a data providing device laid on a road, wherein the data providing devices include a detector for detecting a traveling state of a vehicle passing over the vicinity thereof and a transmitter for sending the traveling state detected to other passing vehicles and a vehicle includes a receiver for receiving data sent from the data providing device. The data providing device itself detects the traveling state of a passing vehicle, and so vehicles without transmitters may be used in this system.

In this case it is preferable that the data providing device should detect the pass time of a vehicle and that the transmitter should send the traveling state and the pass time. Also, it is preferable that the number of the data providing devices laid on a road should be greater than one and that there should be a control center for communicating, through the data providing devices, to a passing vehicle traffic data obtained from traveling data sent from each of the data providing devices. It is preferable that the control center should predict the occurrence of traffic congestion based on the pass time and speed of a vehicle included in the traveling data and communicate the occurrence of traffic congestion as the traffic data.

Furthermore, in order to achieve the above object, a vehicle traveling guidance system according to the present invention comprises a memory laid on a road for storing traveling data on a passing vehicle and a transmitter laid on the road for sending the traveling data to a next passing vehicle. Each vehicle can control its traveling based of traveling data of the preceding vehicle.

DESCRIPTION OF THE EMBODIMENTS

Based on the drawings, embodiments according to the present invention will be described below with an electronic wave tag laid on a road surface as an example of a data providing source.

Embodiment 1

Figure 1:
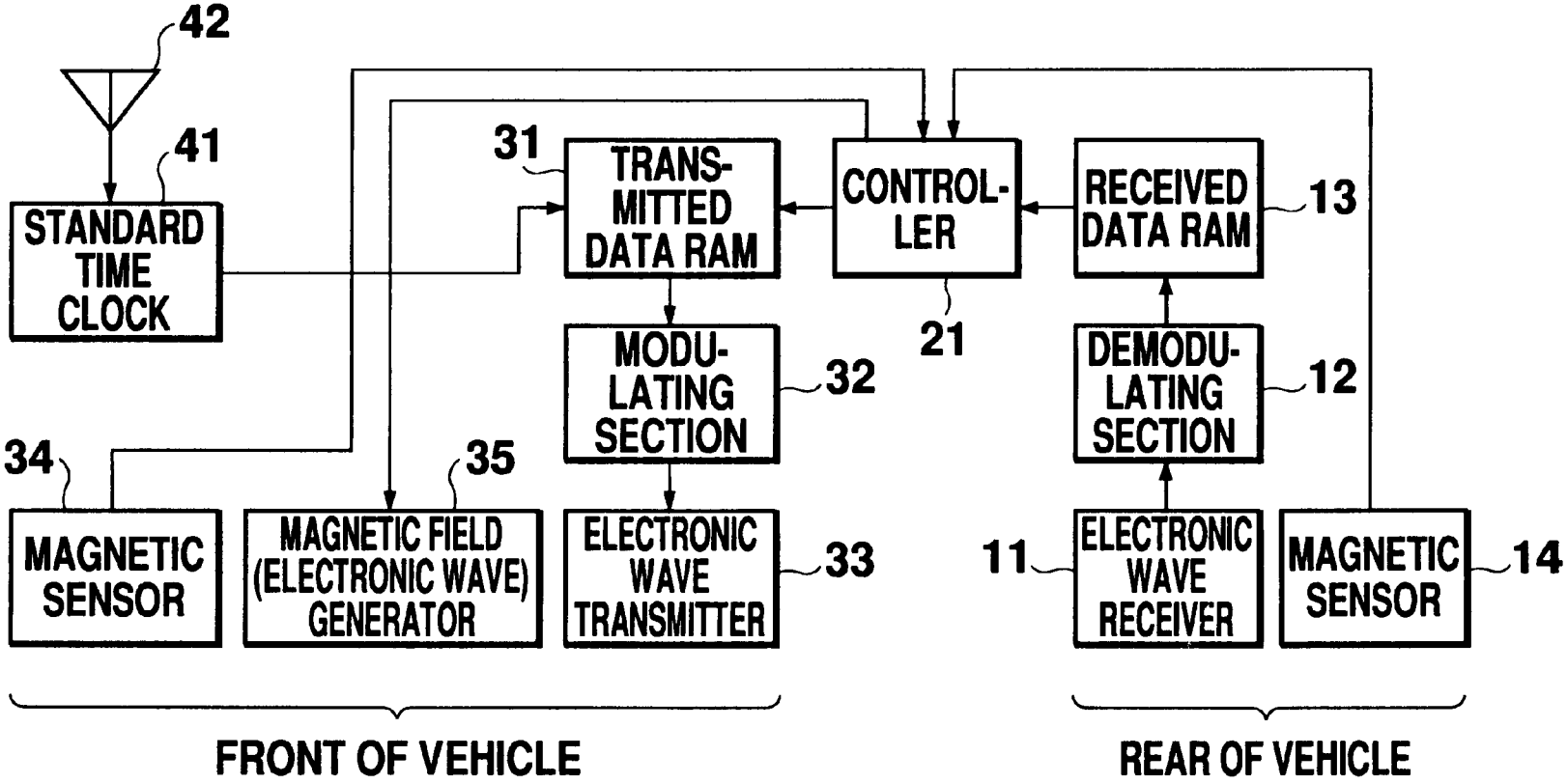
FIG. 1 is a block diagram of a configuration of a vehicle of embodiment 1.
Figure 2:
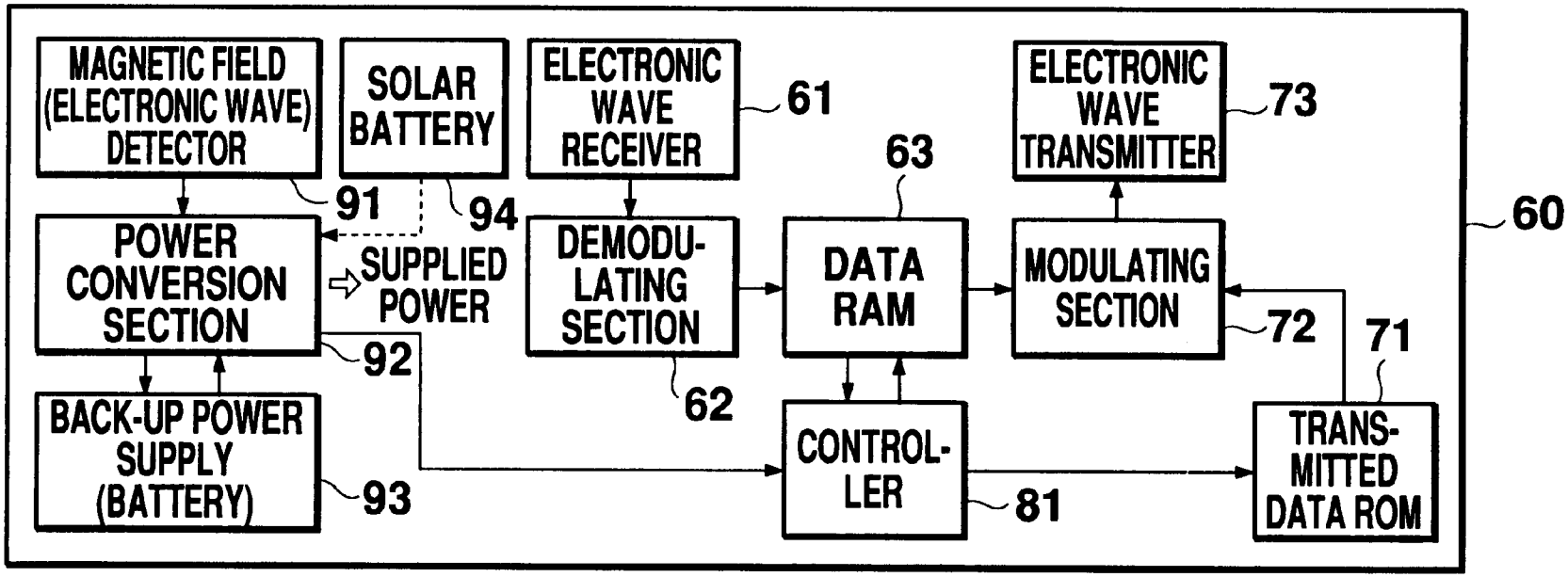
FIG. 2 is a block diagram of a configuration of an electronic wave tag of embodiment 1.

FIGS. 1 and 2 show a system configuration of embodiment 1: FIG. 1 is a block diagram of a configuration of a vehicle, while FIG. 2 is a block diagram of a configuration of an electronic wave tag laid on a road surface. The basic configuration of the road surface is the same as that described in Japanese Patent Application No. Hei 7-157878, a related application. That is, electronic wave tags are laid on a road surface at fixed intervals (for example, 100 m) for sending data on the shape of the road surface to a passing vehicle, and a pair of magnetic markers is laid on the road surface at the side of each electronic wave tag from which a vehicle would approach. A vehicle recognizes its relative position (displacement) to the road surface by detecting the presence of magnetic markers, obtains data on the shape of the road surface from the electronic wave tag while controlling steering, and controls steering according to the shape of the road surface in intervals where no magnetic markers exist.

At the rear of a vehicle of FIG. 1, there are an electronic wave receiver 11 for receiving electronic waves from an electronic wave tag, a demodulating section 12 for demodulating electronic waves received by the electronic wave receiver 11, a received data memory (RAM) 13 for storing data demodulated by the demodulating section 12, and a magnetic sensor 14 for detecting magnetic markers laid on a road surface with an electronic wave tag. Received data stored in the RAM 13 and magnetic data detected by the magnetic sensor 14 are provided to a controller 21 comprising microcomputers.

Also, at the front of the vehicle of FIG. 1, there are a transmitted data memory (RAM) 31 for storing data from the controller 21; a modulating section 32 for modulating transmitted data; an electronic wave transmitter 33 for sending modulated data to an electronic wave tag; a magnetic sensor 34 for detecting, as with the magnetic sensor 14 at the rear of the vehicle, magnetic markers laid on a road surface; a magnetic field generator 35 for generating a magnetic field as driving power of an electronic wave tag; a standard time clock 41 for detecting when the vehicle passed over an electronic wave tag; and a GPS receiver 42 for obtaining a reference time used to calibrate the standard time clock 41. The calibration of the standard time clock 41 may also be performed by a reference time obtained by a receiver for receiving a standard-frequency signal such as JJY. When the magnetic sensor 14 detects a magnetic marker on a road surface, the magnetic field generator 35 is excited at an instruction from the controller 21. An electronic wave tag obtains desired power from a resulting magnetic field by the magnetic field generator 35 and a special power supply is therefore not necessary for the electronic wave tag. An electronic wave tag starts only when a vehicle passes over it. Also, data on a standard time calibrated by a reference time from the GPS receiver 42 is stored in the transmitted data memory 31 and is sent, together with traveling data such as the speed and ID of a vehicle, to an electronic wave tag. Sending of data is performed either after the magnetic sensor 14 detects a magnetic marker and the magnetic field generator 35 generates a magnetic field, or with the generation of a magnetic field after the magnetic sensor 14 detecting a magnetic marker.

FIG. 2 shows a configuration of an electronic wave tag 60. The communication system comprises an electronic wave receiver 61 for receiving traveling data (ID, speed, and pass time) sent from a passing vehicle, a demodulating section 62 for demodulating received data, a data memory (RAM) 63 for storing demodulated data, a transmitted data ROM 71 for storing transmitted data, a modulating section 72 for modulating traveling data from the data memory (RAM) 63 and data output from the transmitted data ROM 71 into traveling data to be transmitted, an electronic wave transmitter 73 for sending traveling data to a passing vehicle, and a controller 81 for controlling the above sending and receiving. The power system comprises a magnetic field detector 91 for detecting a magnetic field generated by the magnetic field generator 35 of a vehicle, a power conversion section 92 including a coil for converting a detected magnetic field into power with electromagnetic induction, and a back-up power supply 93 for providing power, in case of necessity, to the power conversion section 92 and storing power. A solar battery 94 for converting, in case of necessity, the sunlight or incident light into electric energy may be used. When power obtained in the power conversion section 92 is provided to the controller 81, control operations begin. Traveling data sent from a vehicle is received and stored in the data memory (RAM) 63. After the data is received, traveling data on the preceding vehicle already stored in the RAM is sent to the passing vehicle. The traveling data to be sent includes the ID, speed, and pass time of the preceding vehicle, and information on the electronic wave tag (for example, location data) stored in the transmitted data ROM 71.

In the above configuration, sending and receiving data in the case of a vehicle passing over the vicinity of an electronic wave tag is performed in the following way. That is, when the magnetic sensor 14 mounted on the vehicle detects a magnetic marker just on this side of the electronic wave tag, the controller 21 causes the magnetic field generator 35 to start in order to provide a magnetic field to the electronic wave tag and causes the electronic wave transmitter 33 to send the ID, speed, and time data on the vehicle to the electronic wave tag. In the electronic wave tag, the magnetic field detector 91 detects a magnetic field and power, with supplementary power coming from the back-up power supply 93, is provided to each section. With the power supply as a trigger, the controller 81 causes the RAM to store ID, speed, and pass time data of the vehicle from the electronic wave receiver 61. Also, the ID, speed, and pass time data of the preceding vehicle stored in the data RAM 63 is sent to the vehicle through the electronic wave transmitter 73. In the vehicle data sent from the electronic wave tag is received by the electronic wave receiver 11 and is provided to the controller 21. The controller 21 controls the traveling of the vehicle based on the received data.

A vehicle passing over an electronic wave tag can receive speed and pass time data of the preceding vehicle in this way, and so can recognize a traveling state of the preceding vehicle. Based on this data, the current vehicle can then determine whether it is traveling properly. This data is especially helpful when the preceding vehicle cannot be seen because of bad weather or a curves in a road. Assuming that a great deal of time has not elapsed since the preceding vehicle passed and that the speed of the preceding vehicle is slower than that of the current vehicle, slowing down the speed of the current vehicle is one of method for maintaining the distance between vehicles.

The back-up power supply 93 may consist of secondary cells or supercapacitors (compact capacitors having large capacitance), which enables it to function as a power supply for holding and driving the data RAM 63 until more than one vehicle passes. By connecting the solar battery 94 to the power conversion section 92, power supply will not break down if the sunlight or light irradiated from an adequate light source can be obtained. Power supply from the solar battery 94 may fail. However, should no vehicle pass for a long enough time for power stored in the back-up power supply 93 to be used up, it would mean that traffic is extremely light and that there is therefore no need for vehicle guidance to consider the distance between vehicles; the effectiveness of this system would not be reduced. In this case, the controller 81 sends a passing vehicle only data stored in the transmitted data ROM 71.

Furthermore, according to a configuration of this embodiment, sending and receiving data between a vehicle and an electronic wave tag is performed with electronic waves. However, data sending and receiving may be performed by optical communication devices using optical signals, such as infrared rays.

Furthermore, according to a configuration of this embodiment, power is provided to an electronic wave tag by generating a magnetic field with the magnetic field generator 35 mounted on a vehicle. However, power may be provided with light by mounting a floodlight projector on a vehicle and a photo-electric converting device on an electronic wave tag.

Embodiment 2

Figure 3:
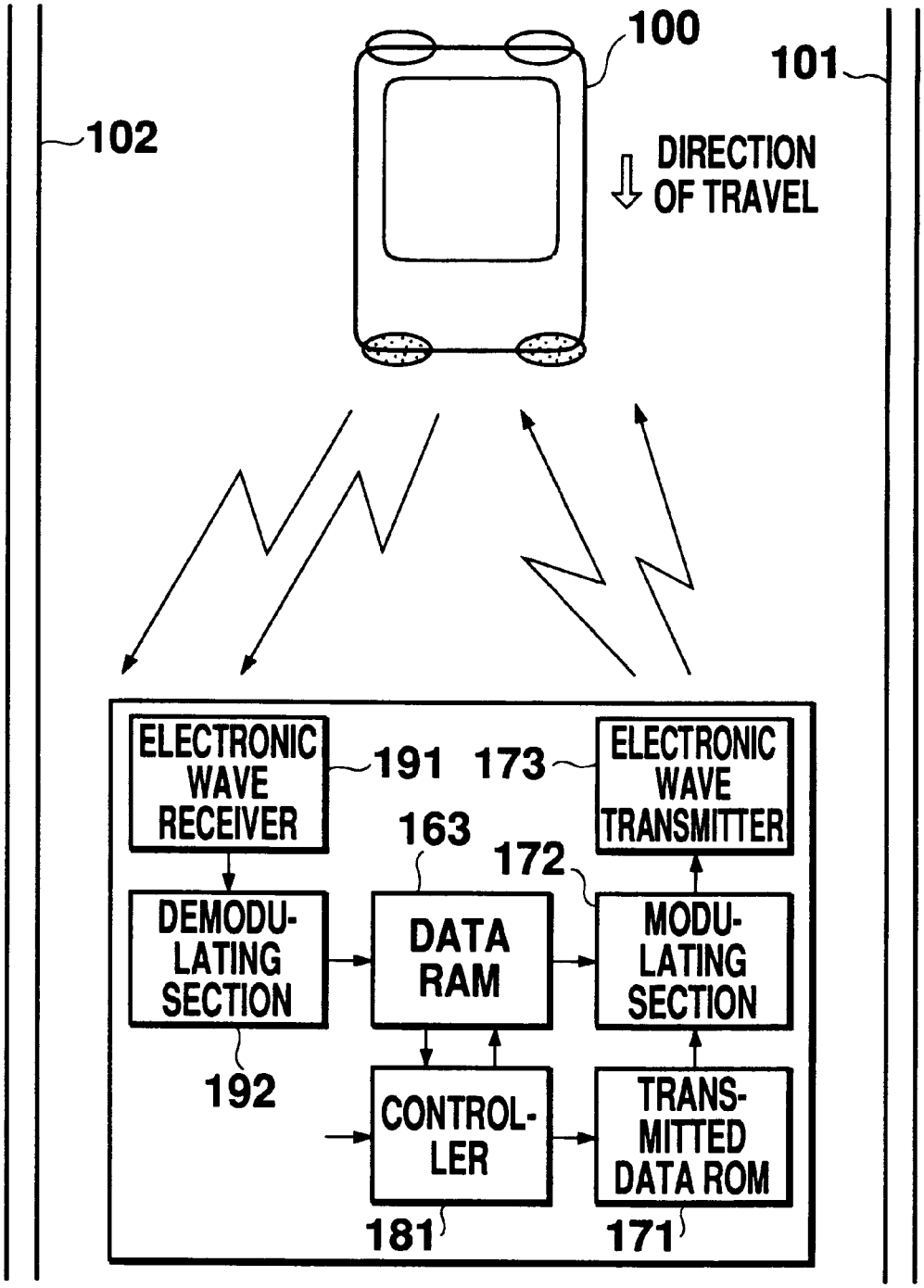
FIG. 3 is a block diagram of a configuration of an electronic wave tag of embodiment 2.

FIG. 3 shows a configuration of embodiment 2. The above embodiment 1 assumed that the transmitter for providing traveling data on a vehicle to an electronic wave tag is mounted on a vehicle. Considering the usual traffic, however, there will exist both vehicles with a transmitter and vehicles without a transmitter. Therefore, this embodiment shows a configuration in which traffic data can be also provided surely to a vehicle without a transmitter.

In FIG. 3, a vehicle 100 traveling an area between lane lines 101 and 102 is not equipped with the electronic wave transmitter 33 shown in FIG. 1.

As in FIG. 2, an electronic wave tag is equipped with an electronic wave transmitter and receiver, but an electronic wave transmitter 173 according to this embodiment also sends radar electronic waves for detecting the speed of the vehicle 100. It may send the radar electronic waves, either all the time or only when a passing vehicle is detected in some way. An electronic wave receiver 191 receives radar electronic waves reflected from the vehicle 100. The reflected radar electronic waves, received by the electronic wave receiver 191 are demodulated by a demodulating section 192 and are provided to a controller 181 in order to detect the speed of a passing vehicle. Speed may be detected using, for example, the Doppler effect. The electronic wave tag is also equipped with an internal clock (not shown) for measuring the time when reflected radar electronic waves are received. This corresponds to the pass time of a vehicle. The pass time, time elapsing after the pass of the preceding vehicle may be measured. The speed and pass time data detected is stored in a data RAM 163. Traveling data on the preceding vehicle (vehicle which passed just prior to a passing vehicle) already stored in the data RAM 163 is modulated by a modulating section 172 and then sent from the electronic wave transmitter 173 to the vehicle currently passing over the electronic wave tag. Traveling data on the vehicle currently passing over the electronic wave tag newly stored in the data RAM 163 is sent to the succeeding vehicle (vehicle which will pass after the passing vehicle).

Even if a vehicle has no transmitter, as described above, this embodiment enables an electronic wave tag itself to obtain the speed and pass time data on a passing vehicle and to provide it to the succeeding vehicle. Even with the usual traffic including various vehicles, therefore, smooth vehicle guidance can be achieved.

An internal clock in an electronic wave tag can be calibrated each time a vehicle with a transmitter passes over the electronic wave tag. In this case, pass time data sent from a vehicle is used. This method improves accuracy.

Embodiment 3

Figure 4:
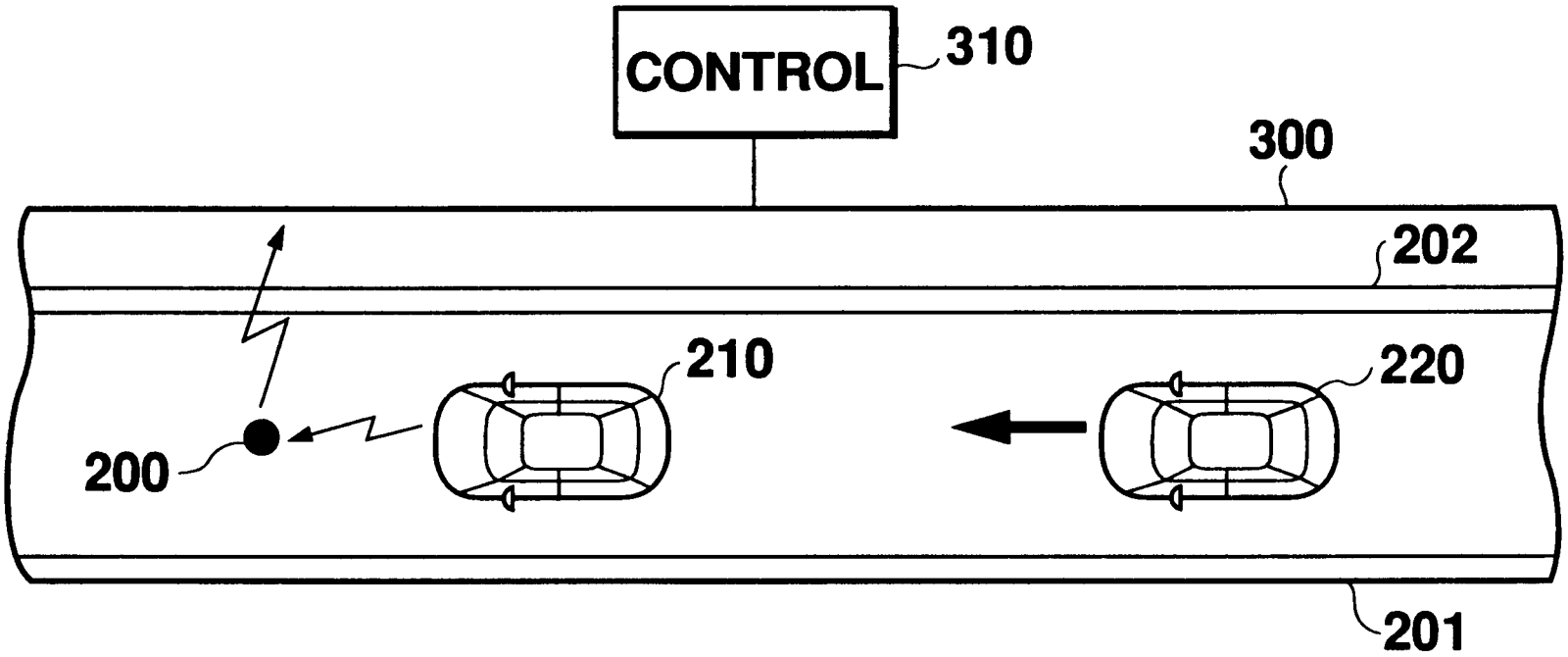
FIG. 4 is a view showing a configuration of embodiment 3.
Figure 5:
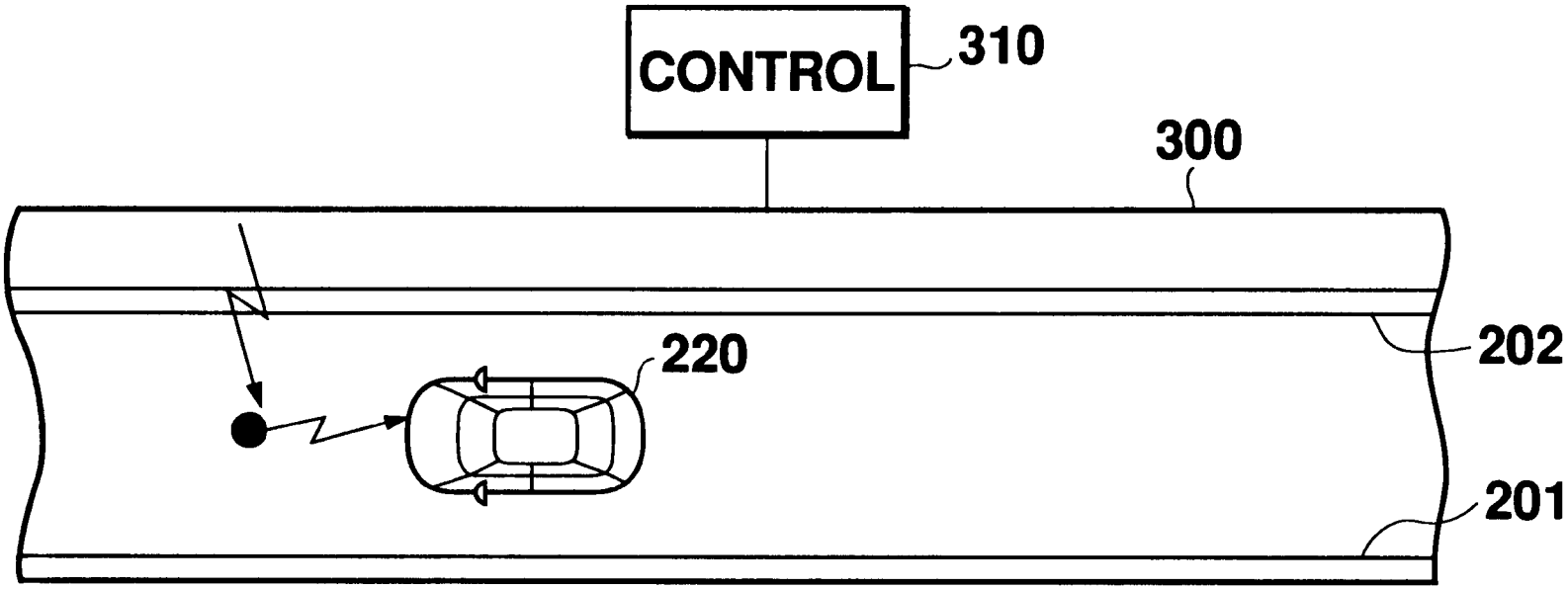
FIG. 5 is a view showing a state at a certain time after the time of FIG. 4.

FIGS. 4 and 5 show a system configuration of embodiment 3. FIG. 4 is a view showing a case where a preceding vehicle 210 passes over the vicinity of an electronic wave tag 200 and FIG. 5 is a view showing a case where a succeeding vehicle 220 reaches the same point. FIGS. 4 and 5, include communication equipment 300, including a beacon and a communication antenna, on the side of a road for receiving electronic waves from the electronic wave tag 200. A control center (monitor center) 310 is connected to the communication equipment 300 by wire or wireless for collecting the ID, speed, and pass time data of a passing vehicle sent from each of the electronic wave tags 200. That is, the electronic wave tag 200 of this embodiment has a function to send traveling data on a passing vehicle, not only to a vehicle passing next but also to the communication equipment 300 (an electronic wave transmitter in FIG. 2 or 3 can have this function) and the control center 310 can perform batch processing of data collected from the electronic wave tag 200.

In FIG. 4, when the preceding vehicle 210 reaches a point near the approach side of the electronic wave tag 200, traveling data on the preceding vehicle 210 is sent from the vehicle to the electronic wave tag 200, as shown in embodiment 1. After receiving traveling data, the electronic wave tag 200 stores it in a data RAM and sends the traveling data of the preceding vehicle 210 to the succeeding vehicle 220, as shown in FIG. 5. Also, the electronic wave tag 200 sends the traveling data on the preceding vehicle 210 to the communication equipment 300, which then sends the traveling data to the control center 310. Based on the speed and pass time data from each electronic wave tag, the control center 310 recognizes the flow of traffic at each point and sends each electronic wave tag data on traffic information at that point. The electronic wave tag 200 having received data on traffic information from the control center 310 sends this data, together with traveling data, to passing vehicles. The data on traffic information includes data on the presence of a damaged vehicle, occurrence of an accident, congestion information, points where traffic congestion is likely to occur from now on, and the like. The following is an example of how congestion is predicted. All the speed and pass time data of a vehicle at each point where an electronic wave tag exists is sent to the control center 310. Therefore, if there is a point where at a certain time the traffic was flowing smoothly and, subsequently, each vehicle slows down while the intervals between vehicle pass times also tend to become shorter, this point can be identified as a congestion point. At this point, even if traffic congestion has not yet occurred, it is considered likely to occur soon. Therefore, congestion prediction data is provided to the electronic wave tags 200 on the approach side of that point from the direction in which vehicles are traveling. Furthermore, the electronic wave tags 200 having received this data send it to passing vehicles, which enables each passing vehicle to predict the occurrence of congestion and to take measures, such as selecting a bypass or decreasing speed.

Data on traffic information may be related to a more limited area. It is assumed that more than one vehicle (for example, three vehicles) is traveling with relatively short distances between them. When the speed of the third vehicle is greater than that of the first or second, the third vehicle may overtake the second. In this case, the control center 310 provides data indicating this to the electronic wave tags 200 over which the second vehicle will pass. This enables the second vehicle to recognize that the succeeding vehicle will overtake it. Information on changing lanes based on detecting signals from a lane line deviation detector separately laid on the side of a road may also be added as the data on traffic information.

Currently, a system in which various types of data is communicated to a vehicle from a control center is known. In this embodiment, however, traffic flow is understand based on the speed data and pass time of a passing vehicle at each point where an electronic wave tag is laid. Therefore, a system according to this embodiment differs greatly from a conventional one in that it can recognize the distance between vehicles at each point and recognize changes our time. Even if the speed of each vehicle is reduced, traffic congestion will not occur when there is an adequate distance between vehicles. That is, congestion prediction with high accuracy can be achieved by considering both the speed and the pass time of a vehicle, as in this embodiment.

The embodiments according to the present invention have been described with the method of using an electronic wave tag laid on a road surface as an example, but a data transmitter-receiver other than an electronic wave tag may be laid on a road surface or on the side of a road.

According to the present invention, as described above, traffic information changing every hour can be provided more precisely to each vehicle traveling on a road surface. As a result, each vehicle can travel more smoothly with this traffic information.

While what has been described are, at present, considered to be preferred embodiments of the invention, it will be understood that various modifications may be made thereto, and it is intended that the appended claims cover all such modifications falling within the true spirit and scope of the invention.

What is claimed is:

1. A vehicle traveling guidance system comprising:

a data providing device installed on a road, and a vehicle wherein said vehicle includes:

a data transmitter for sending said data providing device speed data and pass time data of the vehicle when the vehicle passes the vicinity of said data providing device, and a data receiver for receiving data sent from said data providing device, and said data providing device includes:

a receiver for receiving said speed data and pass time data, and a transmitter for sending other passing vehicles said speed data and said pass time data.

2. The vehicle traveling guidance system according to claim 1, wherein said data providing device is an electronic wave tag.

3. The vehicle traveling guidance system according to claim 1, wherein a plurality of said data providing devices are installed on a road, said system further comprising:

a control center for communicating, through said data providing devices, to a passing vehicle traffic congestion information and data of a predicted traffic congestion point obtained from said speed data and time data transmitted from each of said plurality of data providing devices.

4. A vehicle traveling guidance system comprising:

a plurality of data providing devices installed on a road, wherein each of said data providing devices includes:

a detector for detecting speed and pass time of a vehicle passing over the vicinity thereof, a transmitter for sending said data of said speed and pass time detected to other passing vehicles, and said system further comprising a control center for communicating through said data providing devices, to a passing vehicle traffic congestion information and data of a predicted traffic congestion point obtained from said speed data and pass time data transmitted from each of said plurality of data providing devices.

* * * * *